United States Patent [19]

Hasircoglu

[11] Patent Number: 4,767,357

[45] Date of Patent: Aug. 30, 1988

[54] DAISY CHAIN CONNECTOR

[75] Inventor: Alexander W. Hasircoglu, Lancaster, Pa.

[73] Assignee: E. I. Du Pont de Nemours and Company, Wilmington, Del.

[21] Appl. No.: 60,345

[22] Filed: Jun. 10, 1987

[51] Int. Cl.[4] ..... H01R 13/00

[52] U.S. Cl. ..... 439/499

[58] Field of Search ..... 439/492, 494, 497, 498, 439/499

[56] References Cited

U.S. PATENT DOCUMENTS

| | | | |
|---|---|---|---|
| 3,727,168 | 4/1973 | Henschen et al. | 439/498 |
| 3,958,852 | 5/1976 | Abraham et al. | 439/499 |
| 4,005,921 | 2/1977 | Hadden et al. | 339/14 R |
| 4,065,199 | 12/1977 | Andre et al. | 439/498 |
| 4,140,360 | 2/1979 | Huber | 339/176 |
| 4,295,254 | 10/1981 | Adams et al. | 29/33 M |
| 4,585,284 | 4/1986 | Koser et al. | 339/17 C |
| 4,632,486 | 12/1986 | Hasircoglu | 339/99 R |
| 4,679,868 | 7/1987 | Hasircoglu | 439/495 |

OTHER PUBLICATIONS

Selected pages from Du Pont Connector Systems Catalog 86-A, Mar. 1986.

Du Pont Bulletin 1240, Jun. 1984.

Du Pont Bulletin 1260, Oct. 1983.

*Primary Examiner*—Joseph H. McGlynn

[57] ABSTRACT

A connector having a plurality of terminals formed therein with the mating ends of the terminals forming stacked pairs across one surface of the connector is characterized by the tail ends of the terminals forming a linear array across another surface of the housing, linearly adjacent pairs of tail ends corresponding to stacked pairs of mating ends. Each tail end has a first and a second conductor mounting surface thereon.

17 Claims, 16 Drawing Sheets

DAISY CHAIN CONNECTOR

FIELD OF INVENTION

This invention relates to an electrical connector and, in particular, to a connector adapted to provide a daisy-chain interconnection between a board or cable connectible to a first, contact, surface of the connector and a pair of cables connectible to a second, termination, surface of the connector.

BACKGROUND OF THE INVENTION

A daisy chain interconnection is a wye form of electrical interconnection defined between a signal input and a corresponding pair of signal outputs. Typically the input and the outputs are defined by arrays of signal conductors, with a corresponding plurality of signal conductors usually being present in all conductor arrays.

Presently, such interconnections are made in either of two manners, the first using a device known in the art as an insulation displacement contact daisy chain connector, and the second using the intermediary of a printed circuit board.

An insulation displacement contact connector requires a relatively wide center to center spacing between adjacent conductors in a given array. Usually the conductors have spacings of at least 0.050 inch. This relatively wide spacing requirement is necessary to physically accommodate the insulation displacement contact itself. If a greater conductor density (i.e., closer spacing between adjacent conductors) is required either to perform a particular end use or to define a system having particular electrical parameters (cross talk immunity, impedance matching, etc.) the daisy chain connector using the insulation displacement contact cannot be used. Exemplary of a typical daisy chain connector of the insulation displacement type is the device manufactured and sold by Connector Systems Division of E. I. Du Pont de Nemours and Company, Inc. as the "Quickie" TM connector. Another example of a connector for mass termination of flat multiple wire cable using slotted contacts similar to insulation displacement tines is shown in U.S. Pat. No. 4,140,360 (Huber).

Present daisy chain connectors of the insulation displacement type are thus not readily applicable for use with evolving, increased conductor density cable technology, such as the high speed, high density cable manufactured by Gore, Inc. under model TLN 1365. Such high speed, high density cable has signal conductors with 0.050 inches center to center spacing (or less) and have one or two shielding conductors placed between the signal conductors. The term "high speed, high density cable" is used throughout this application to denote such a cable arrangement.

In addition, the presently available insulation displacement contact daisy chain connector is usable only with conductors covered with a jacket of polyvinyl chloride or similar type insulation. Since the evolving high speed, high signal density cables are insulated with a form of coating made from TEFLON ® fluorocarbon resin, a connector of the insulation displacement contact type is not reliable for use with such cables. Instances are known where a portion of a coating of the type used on the high speed, high density cable has become trapped between the tines of an insulation displacement contact, thus effectively insulating the wire in the cable from the contact or seriously impairing the electrical reliability of the contact.

A daisy chain interconnection formed using the circuit board expedient is able to accommodate the tighter conductor spacing and the cable construction used by the high speed, high density cable. However, to form such an interconnection using a board it is necessary to increase the number of terminations involved as well as to utilize tracings on the surface of the board as part of the signal conduction paths. A termination is required between the conductor and the board and the board and its associated connector. Both of these terminations introduce an electrical reflection into the signal path, thus decreasing the integrity of the transmitted signal. The tracings on the board also introduce other electrical variables which diminish the signal integrity. Moreover, use of the board is disadvantageous from the standpoint of manufacturing cost.

Accordingly, in view of the foregoing it is believed to be advantageous to provide a connector adapted to form a daisy chain interconnection using high speed, high density cables without the use of a circuit board and its attendant disadvantages.

SUMMARY OF INVENTION

The present invention relates to an electrical connector of the type adapted to form a daisy chain interconnection between at least two cables, typically of the multiconductor type, and either another cable or circuit board. The connector includes a housing having a first, contact, surface and second, termination, surface thereon. A plurality of terminal members is mounted within the housing, with each terminal member having a mating end and a tail end thereon. The mating ends may exhibit either a male or a female configuration. Each terminal member is mounted in the housing in an arrangement having stacked pairs of mating ends of terminal members. The tail end of each terminal member projects from the termination surface of the housing, with the tail ends being aligned to form a linear array of tail ends. Linearly adjacent pairs of tail ends correspond with stacked pairs of mating ends.

The terminal members may take a variety of configurations. In one embodiment of the invention the tail end of the terminal member has a planar blade configuration, with a first, upper, outside surface and a second, lower, outside surface thereon. The upper and lower outside surfaces respectively define the conductor mounting surfaces. Each of the mounting surfaces may each be provided with a solder well, if desired. Both of the mounting surfaces of the blade are spaced a predetermined clearance distance from the corresponding upper and lower surfaces of the housing. In the most preferred instance the clearance distances betwen the mounting surfaces on the blade and the corresponding surfaces of the housing are equal.

In an alternate embodiment of the invention the tail end of the terminal members may have a generally Y-shape, with each leg of the Y having a confronting surface and an outside surface thereon. The outside surfaces define the mounting surfaces for the conductors and are, in the preferred case, each spaced the same clearance distance from the corresponding upper and lower surfaces of the housing.

In still another alternate embodiment the tail end of the terminal members has the form of an inverted U shape, with each leg of the U having a confronting surface and an outside surface. Again, the outside surfaces of the U-shaped tail end define the mounting surfaces for the conductors and are preferably equally spaced from the surfaces of the housing.

In the latter two embodiments solder wells may be placed in the outside surfaces of each tail end of the terminal member.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 1:
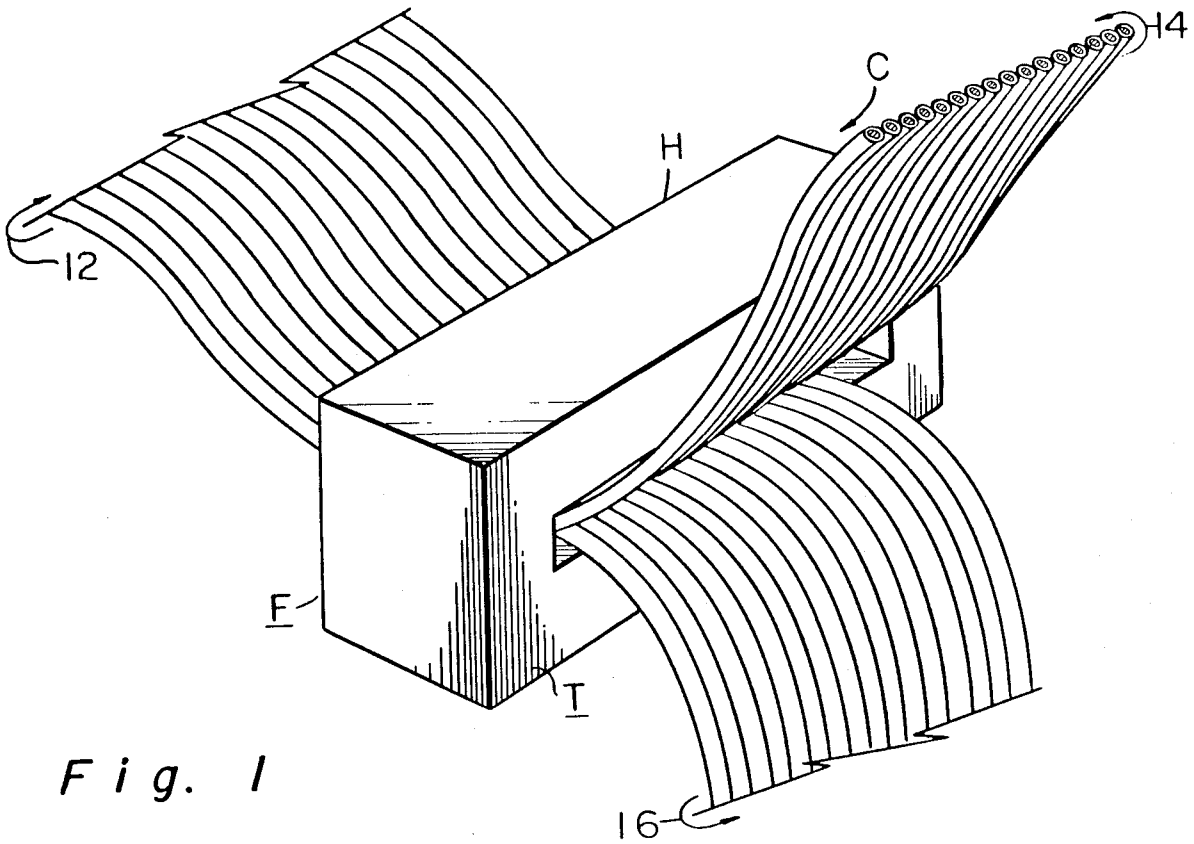
FIG. 1 is a definitional diagram using a highly stylized representation of a conenctor as used to form a daisy chain interconnection between arrays of signal conductors.

Throughout the following detailed description similar reference numerals refer to similar elements in all figures of the drawings.

With reference to FIG. 1 shown is a definitional drawing using a highly stylized representation of a connector generally indicated by the reference character C to form a daisy chain interconnection among arrays of signal conductors, indicated in FIG. 1 by reference characters 12, 14 and 16, respectively. Each signal conductor array 12, 14 and 16 has a corresponding plurality N of electrical conductors contained therein. In the drawing sixteen signal conductors are shown in the arrays 12, 14 and 16, although it should be understood that an array may contain any desired number of conductors. Moreover, it could occur in some instances that the arrays may contain differing numbers of conductors. The connector C includes has a housing H having a front, or contact, surface F thereon at which the signal conductors of the array 12 are connected. The housing H also has a rear, or termination, surface T at which the conductors in the arrays 14 and 16 are connected.

A daisy chain interconnection is, in general, a wye form of electrical interconnection between a signal input and a corresponding pair of signal outputs. In one possible implementation the connector C is arranged to form a daisy chain interconnection between signal conductors in an input signal conductor array 12 and a corresponding pair of conductors in an output signal conductor arrays 14 and 16, respectively. In this instance the input array of signal conductors 12 may be configured as either an appropriately terminated circuit board or a high speed, high density cable. The output signal conductor arrays 14 and 16 then both take the form of high speed, high density cables. It should be understood that, as noted earlier, the cables may include shielding or ground conductors (in the form of metallic wires) in addition to the signal conductors (also in the form of metallic wires) carried therein. The cables are jacketed by a suitable insulating jacket, also as discussed above.

In an alternate configuration the connector C may be used to form a daisy chain interconnection between a conductor in an input signal conductor array 14 and the corresponding pair of output signal conductors in signal conductor arrays defined by the arrays 12 and 16, respectively. In this arrangement the input signal conductor array 14 would take the form of a high speed, high density cable. The output signal conductor array 16 also takes the form of a high speed, high density cable while the other output signal conductor array 12 may again be configured from either an appropriately terminated board or a high speed, high density cable. It should be noted that in this alternate configuration multiple connector daisy chains may be formed, with the output signal conductor array (defined by the cable 16) itself defining the input signal conductor array to a subsequent connector (not shown).

With reference to FIGS. 2 through 6 shown is a first embodiment of a connector 10 in accordance with the present invention adapted to form a daisy chain interconnection in the manner of the connector C, as discussed above. The connector 10 includes the housing generally indicated by the reference character 18 corresponding to the housing H discussed above. The housing 18 is preferably formed from a hollow, substantially rectangular shell 26 that is joined to an elongated terminal bar 28. In the embodiment shown in FIGS. 2, 7 and 12 the jointure is effected by the interengagement of a latch 30 on the exterior of the terminal bar 28 with a slot 32 provided in the shell 26. The front, or contact, surface 20 (corresponding to the surface F in FIG. 1) of the housing 18 is defined by the front surface of the shell 26, while the rear, or termination, surface 22 of the housing 18 (corresponding to the surface T in FIG. 1) is defined by the exposed rear surface of the terminal bar 28. The top and bottom surfaces of the shell 26 define the upper and lower surfaces 34 and 36, respectively, of the housing 18 of the connector 10.

Figure 2:
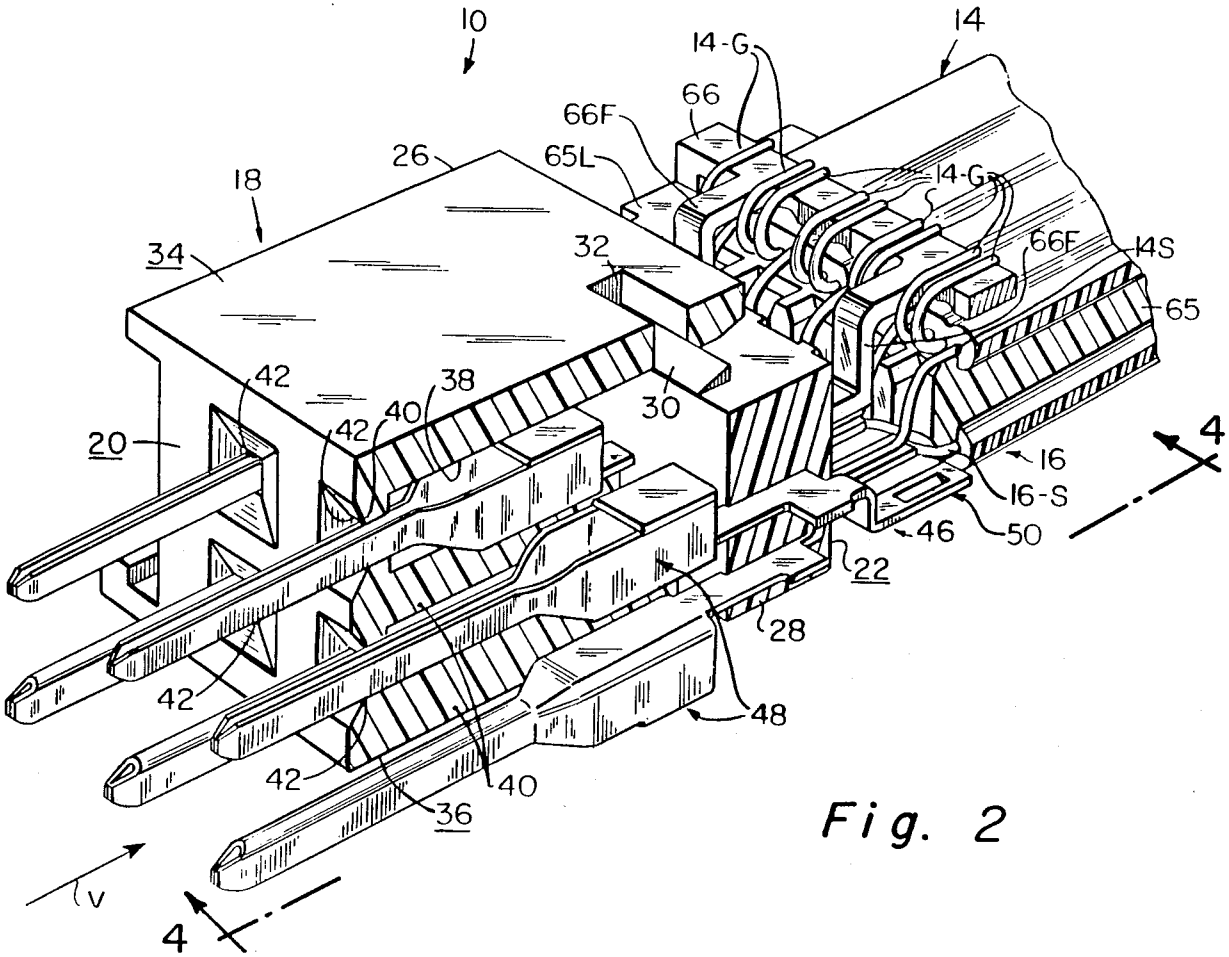
FIG. 2 is a perspective view of a daisy chain connector in accordance with a first embodiment of the present invention with portions of the connector housing being broken away for clarity of illustration.
Figure 7:
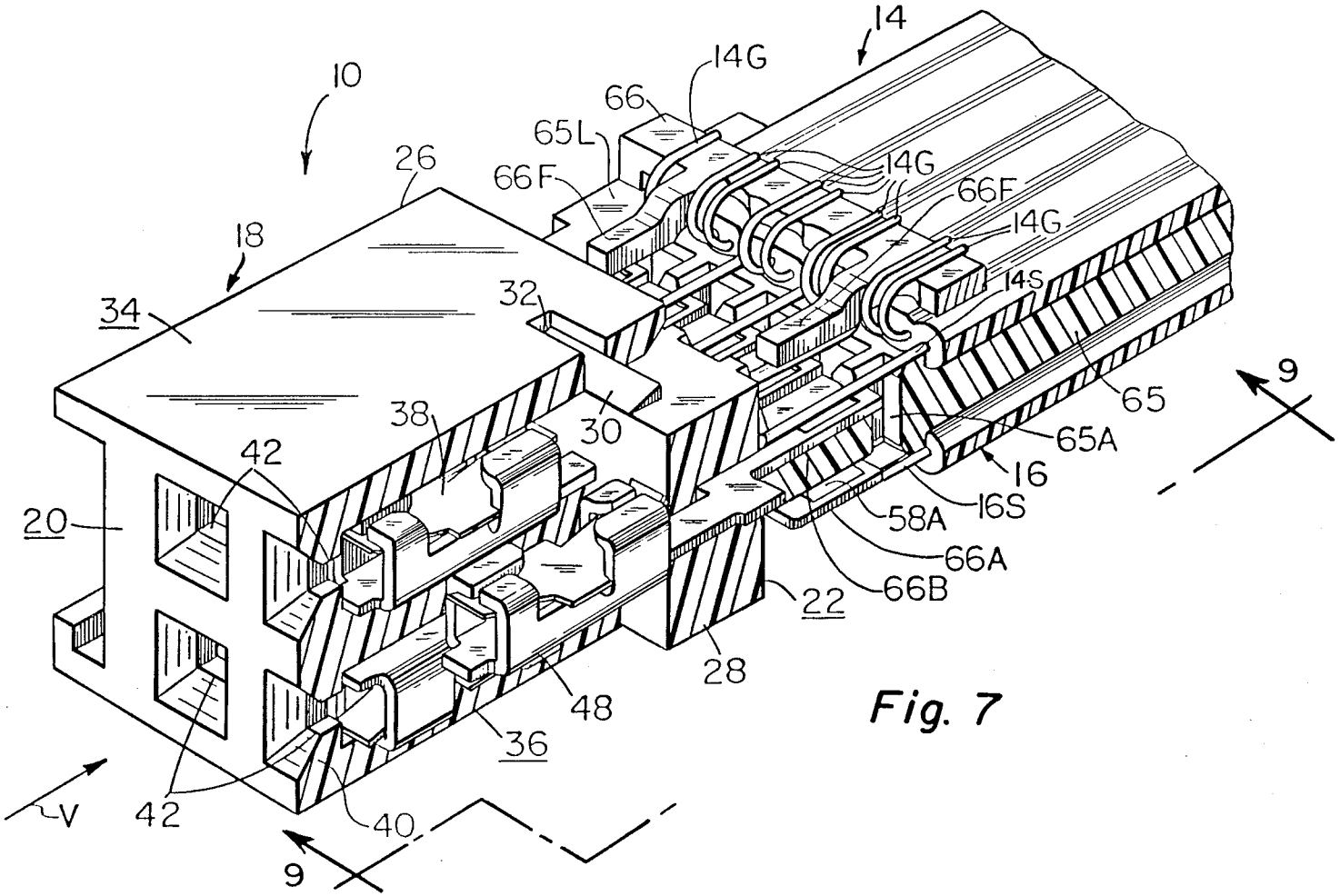
FIG. 7 is a perspective view of a daisy chain connector in accordance with a second embodiment of the present invention with portions of the connector housing being broken away for clarity of illustration.
Figure 12:
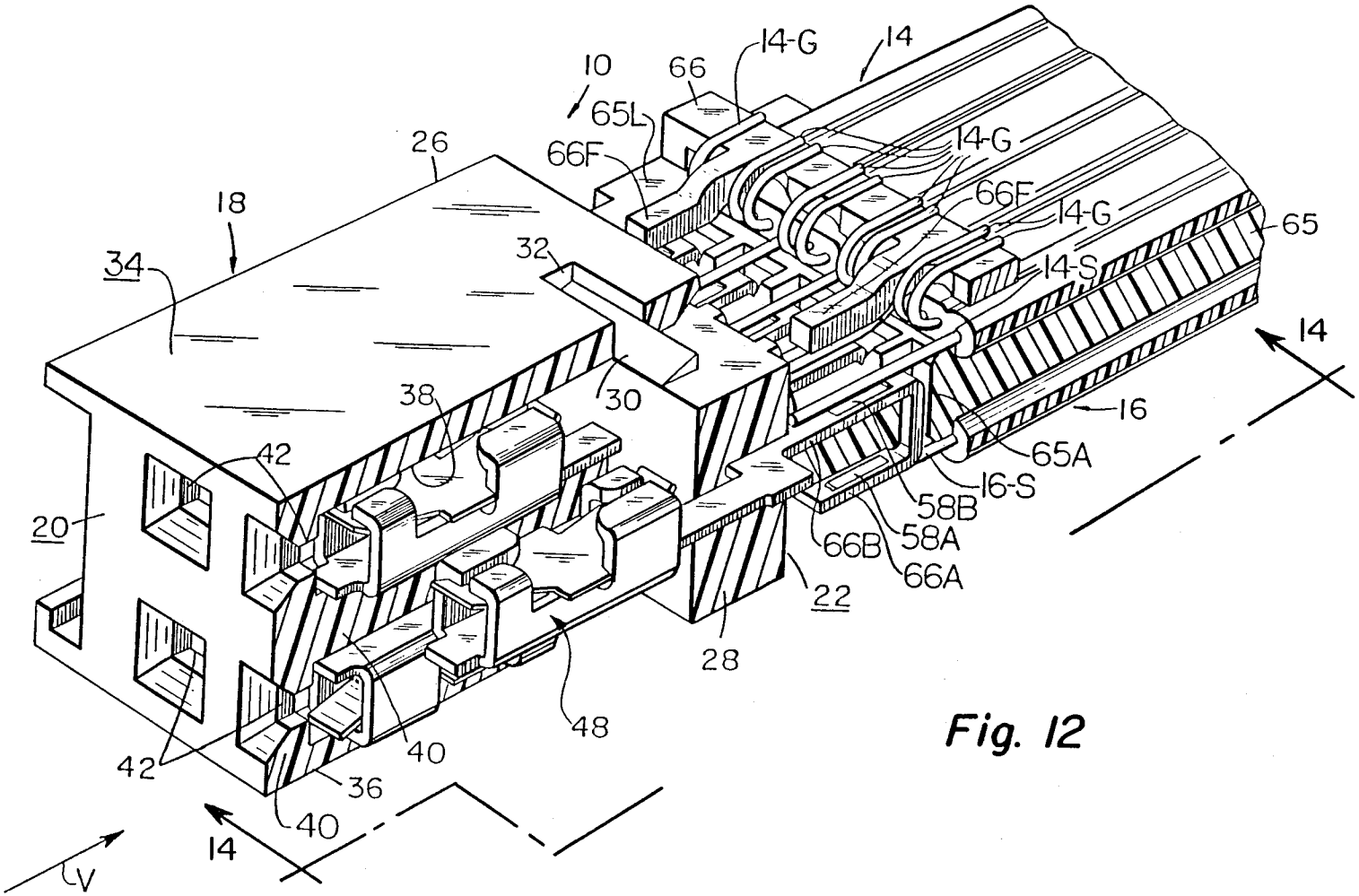
FIG. 12 is a perspective view of a daisy chain connector in accordance with a third embodiment of the present invention with portions of the connector housing being broken away for clarity of illustration.

The interior of the shell 26 is subdivided into a plurality of cells, or compartments, 38 by vertical and horizontal interior walls 40. Communication between the region exterior of the shell 26 and the compartments 38 defined within the shell 26 may be effected through an array of vertically stacked pairs of windows 42 which open across the front contact surface 18 of the connector 10. In the usual case the number of compartments 38 corresponds to the number N of signal conductors in the arrays 12, 14 and 16. In FIGS. 2, 7 and 12 the array 12 of signal conductors is not shown.

Figure 16A:
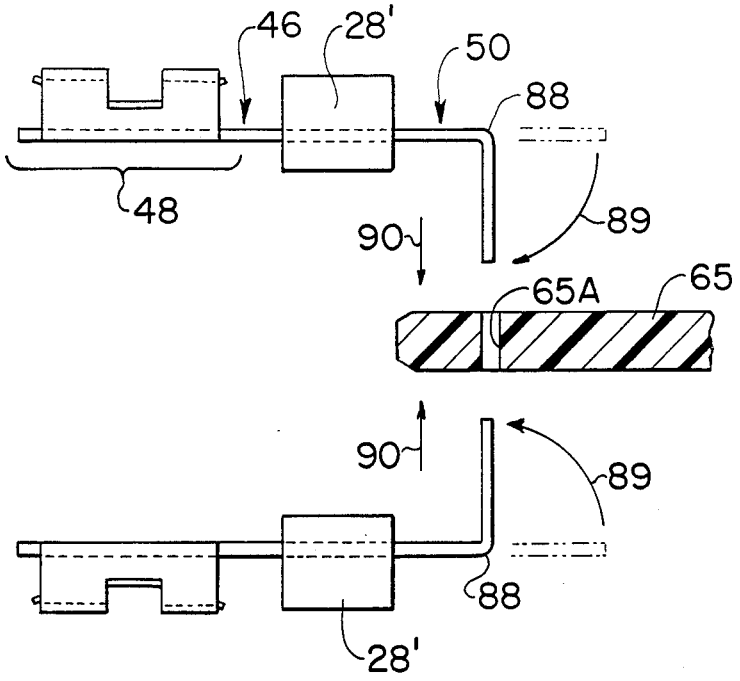
FIGS. 16A and 16B illustrate the sequence of steps used to form a terminal member used in the connector in the embodiment of FIG. 12.
Figure 16B:
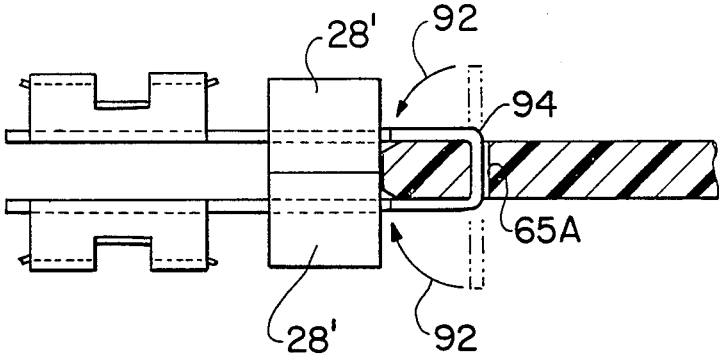

The shell 26 and the terminal bar 28 are typically formed from a suitable high strength, heat resistant plastic material such as RYTON® polyphenylene sulfide sold by Phillips Chemical Company, Bartlesville, Okla. by an injection molding process. The terminal bar 28 is molded by introducing the plastic material into a mold within which an array of terminal members 46 is positioned. As a result the terminal bar 28 is produced which carries that number N of terminal members 46 equal to the number of signal conductors in the arrays 12, 14 and 16 (FIG. 1). In FIGS. 2, 4, 6, 7, 9, 12 and 14 the terminal bar 28 is shown as a unitized integral mass of plastic material. In actuality the bar 28 is formed by joining blocks 28′ (FIGS. 16A, 16B) of plastic material which have the terminals embedded therein along the planar surfaces thereof to define the structure of the terminal bar 28 shown in the remaining Figures. When so joined the blocks function as a unitized integral mass to support the terminal members. Each of the blocks 28′ is a hermaphroditic part. The inner surface has a male protrusion (not shown) which fits into a female pocket (not shown) when the parts are joined. This engagement holds and locates both parts until they are latched to the shell 26, which holds the conjoined parts together. Of course any alternate jointure arrangement may be used.

Figure 3:
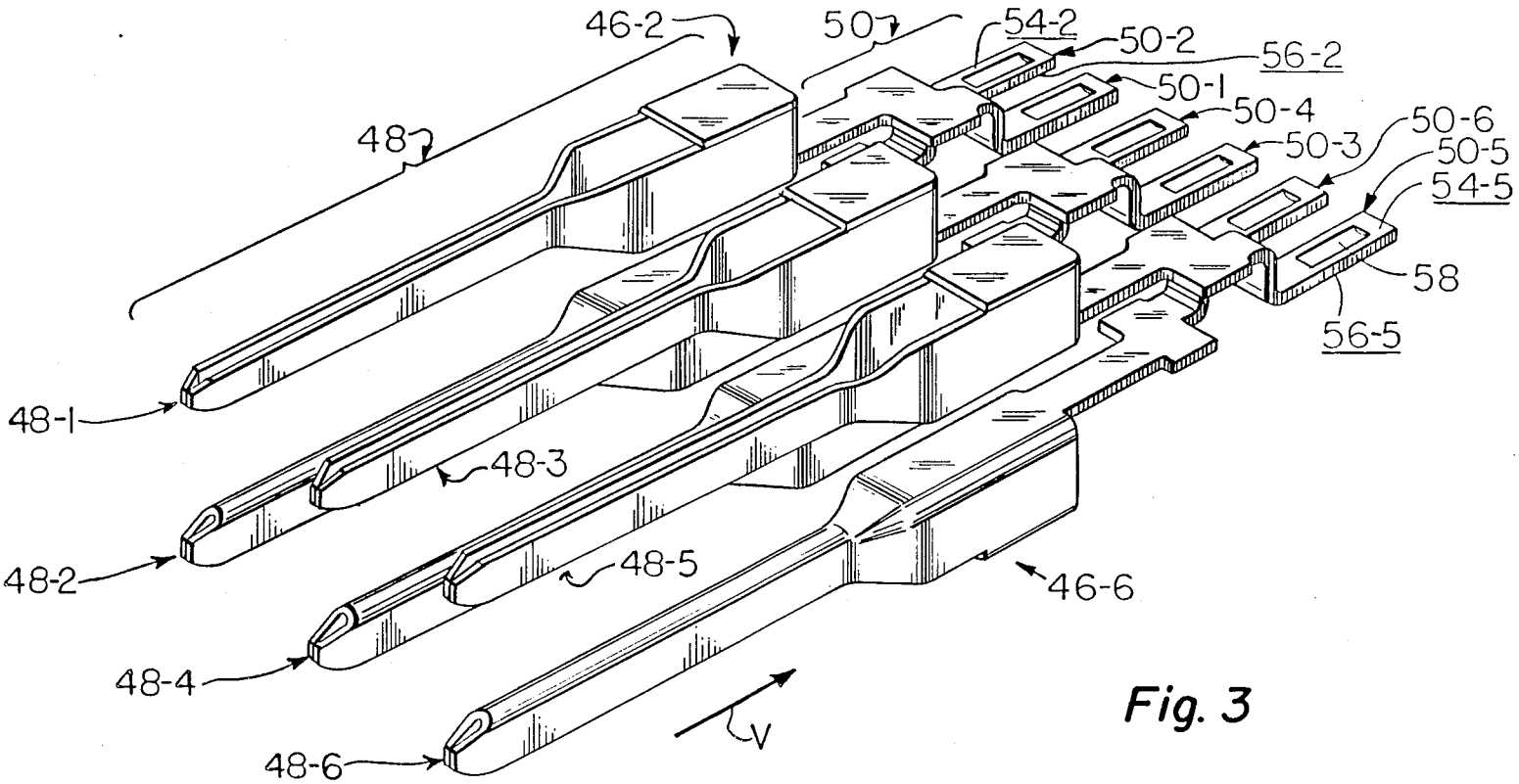
FIG. 3 is an isolated perspective view of a number of the terminal members used in the connector shown in FIG. 2.

As is best seen in FIG. 3 each terminal member 46 includes a forward, or mating, end portion 48 and a rear, or tail, end portion 50. A shown in FIGS. 4 and 5 the tail end portion 50 of each terminal member 46 projects rearwardly from the termination surface 22 of the housing 18. (In FIG. 5 the housing 18 is shown in dot-dash lines.) Preferably the tail end portions project perpendicularly from the termination surface 22. The mating end portion 48 of each terminal member 28 extends forwardly from the terminal bar 34 and each is received within one of the compartments 38 defined on the interior of the shell 26 (FIG. 2).

The mating end portion 48 may take either a male or female form, dependent upon the termination provided to the signal conductors in the array 12 to be joioned at the contact surface 20 of the connector 10. In FIG. 2 the mating end portion 38 of the terminal member 46 is shown as a male pin. In subsequent FIGS. 7 and 12, depicting alternate embodiments of the invention, the mating end portion 48 of the terminal members 46 is shown as a female receptacle. The male pins project outwardly of the housing 18 through the window 42 of the compartment 38 with which they are associated. The female receptacles are contained completely within the associated compartment 38.

In the embodiment of the invention shown in FIGS. 2 through 6 the tail end portions 50 of the terminal members 46 are in the form of planar blades having upper and lower outside surfaces 54 and 56, respectively (FIG. 3). As will be developed herein the outside surfaces 54, 56 present mounting surfaces each of which is able to receive a conductor thereon. Each of the surfaces 54, 56 lies in a plane that is substantially perpendicular to the termination surface 22. Each surface 54, 56 has a solder well 58 formed therein. (The solder well 58 in the surface is perhaps best seen in FIG. 4). As may also be best seen in FIG. 4 the surfaces 54, 56 are spaced by clearance distances 60, 62, respectively from the corresponding upper and lower surfaces 34 and 36 of the housing 18. In the preferred embodiment the distances 60 and 62 are equal, but it should be understood such an arrangement is not necessarily mandated. The tail ends 50 of the terminals 46 could be offset by some predetermined distance (i.e., the distances 60, 62 could be made unequal by the amount of the offset). Also, in the preferred case the blades extend in a substantially perpendicular manner from the surface 22 of the housing 18.

Figure 5:
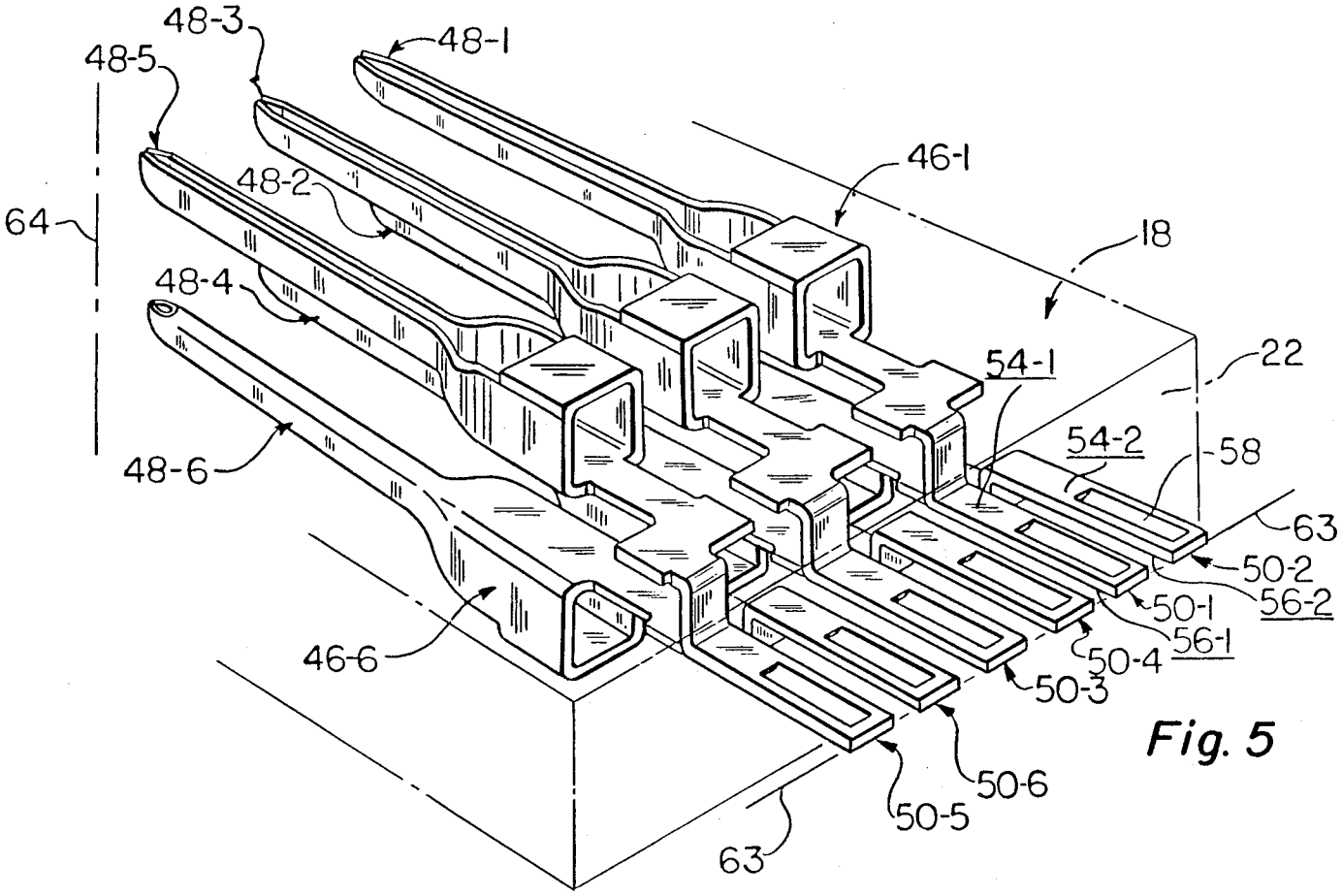
FIG. 5 is an end view taken along section lines 5—5 in FIG. 4; with the connector housing shown in dot-dash lines illustrating the relationship between the mating and the tail ends of the terminals used in the connector of FIG. 2.

In accordance with the present invention the tail ends 50 of the terminal members 46 are aligned on an axis 63 (FIG. 5) that extends transversely across the termination surface 22 of the housing 18 to form a linear array of tail ends thereacross. As is best seen in FIG. 5, the linear array of tail ends 50 is arranged such that linearly adjacent pairs of tail ends 50, e.g., the tails 50-1, 50-2, correspond to pairs of mating ends 48, i.e., the ends 48-1, 48-2, respectively, which are stacked vertically above each other along a vertical reference axis 64. A similar relationship holds for linearly adjacent tails 50-3, 50-4 and their respective associated vertically stacked mating ends 48-3, 48-4. The described relationship also applies to the tails 50-5, 50-6 and their respective associated mating ends 48-5, 48-6. It should be appreciated that all tails and associated mating ends used within a given connector would pair with linearly and vertically adjacent portions, as described.

Figure 4:
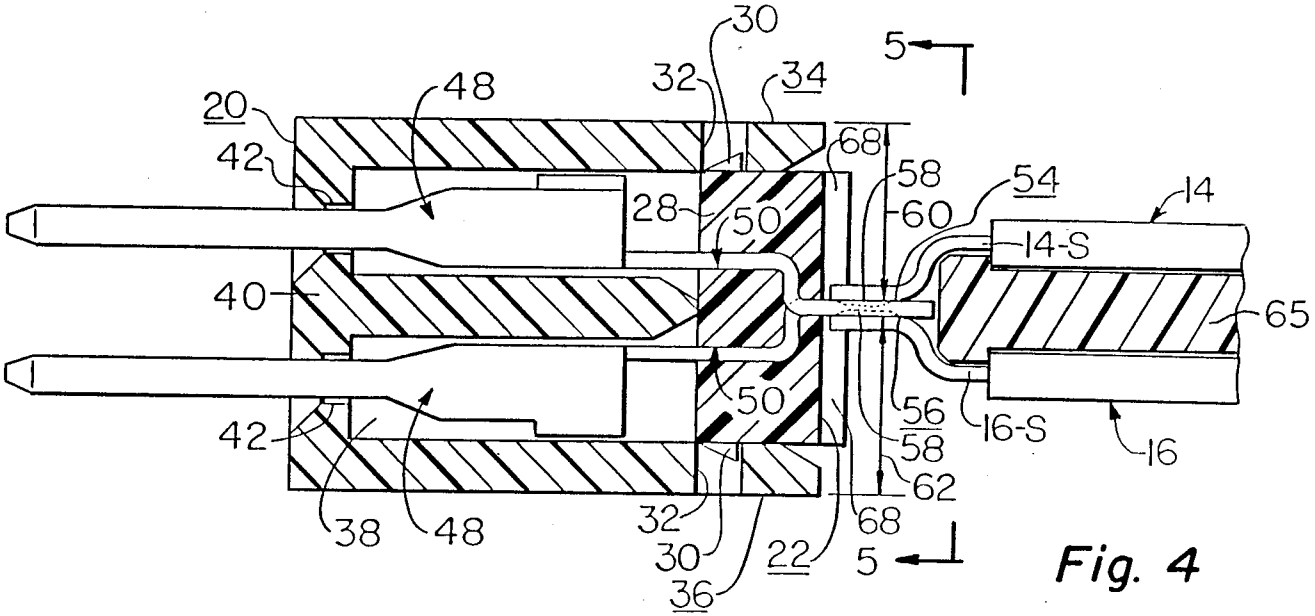
FIG. 4 is a side elevational view entirely in section taken along section lines 4—4 in FIG. 2.

As a result of the described arrangement the outside surfaces 54, 56 of the tail ends 50 are presented as mounting surfaces available to form a daisy chain interconnection with the signal conductors in both of the arrays 14 and 16. The interconnection may be formed in any convenient fashion. For example, as seen in FIGS. 2 and 4 the individual conductors in each of the arrays 14, 16, typically configured as a cable, may be placed on a suitable support substrate 65, such as a an insulating plastic member. The appropriate ground conductors, e.g., conductors 14-G (FIG. 2), in the cable 14 and the ground conductors (not visible) in the cable 16 are bent backward to overlie a ground bus bar 66. The bus bar 66 is not illustrated in all of the Figures. In some instances the ground connection may be applied to selected ones of the terminals 46 of the connector. In this event fingers 66F extend from the bar 66 to the tail end of the appropriate terminal. The signal carrying conductors 14-S, 16-S of the cables 14, 16 are guided by the guide channels 68 (FIG. 6) formed on the rear termination surface 22 of the housing 18. The signal carrying conductors 14-S, 16-S are mounted into contact with the upper and lower outside surfaces 54, 56 of the blades of the tail end portions 50 of the terminal member 46 and are soldered or otherwise suitably connected thereto. The substrate 65 is attached to the connector 10 by a pair of lateral latch arms, one of which 65L, is visible in FIG. 2. The ends of the latch arms 65L carry latches generally similar to the latch 30. The latches at the end of the arms 65L engage slots or abutments which are provided at the lateral ends of the housing 18.

An alternate embodiment of the invention is shown in FIGS. 7 through 11. This embodiment differs primarily from that discussed in connection with FIGS. 1 to 6 in the configuration of the tail end portion 50 of the terminal members 46. In addition, as noted earlier, the mating end portions 48 are shown as female receptacles. In this embodiment of the invention the tail end portions of the terminal member 46 (best seen in this regard in FIGS. 8 and 11) are provided with double legs 66A, 66B in a generally Y-shaped arrangement. The lower leg in each double leg is indicated by the character 66A while the upper leg is indicated by the character 66B. (The same relationship holds for FIGS. 12 to 16). Each of the legs 66A, 66B is provided with a confronting surface 70A, 70B and an outside surface 72A, 72B. The outside surfaces 72A, 72B of each leg 66A, 66B, respectively, are each provided with a solder well 58A, 58B. As in the case of the embodiment of FIGS. 2 to 6 the outside surfaces 72A, 72B present mounting surfaces for the conductors of the cables 14, 16. The tail ends 50 extend perpendicularly to the termination surface 22.

The terminal members 46 used in this embodiment of the invention are preferably formed from integral stock, stamped to provide a generally planar blank, as shown in FIG. 11A (with the mating end portion 48 removed in FIG. 11A for clarity of illustration). Again it should be understood that the mating end of the terminal may assume either a male or a female configuration. Whatever the configuration of the mating end of the terminal one of the legs, e.g., the leg 66B, is originally formed slightly longer than the other of the legs. The longer of the legs 66B is bent, as at 82, to equalize the lengths (i.e., so that the ends are coincident) (FIG. 11B). Thereafter the legs are bent (FIG. 11C) along an axis 84 generally parallel to the axis 86 of of the terminal member 46 to bring the legs 66A, 66B into the confronting relationship shown in the FIG. 11D.

Figure 8:
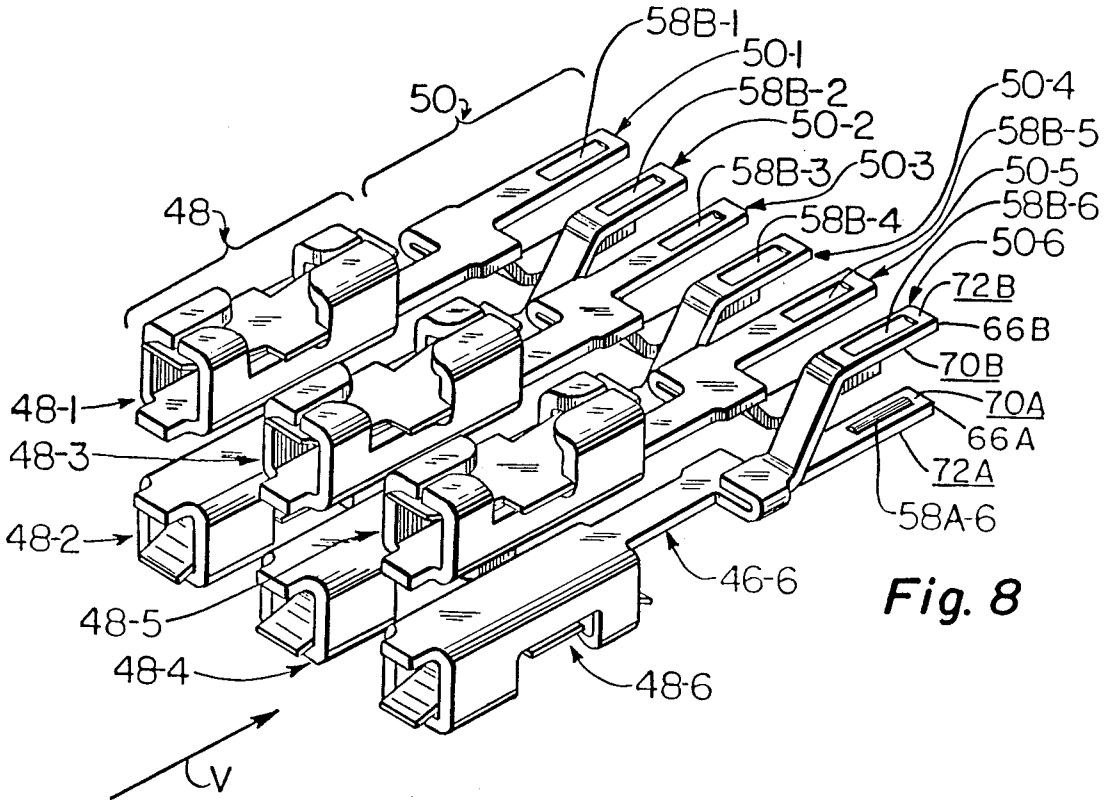
FIG. 8 is an isolated perspective view of a number of the terminal members used in the connector shown in FIG. 7.
Figure 9:
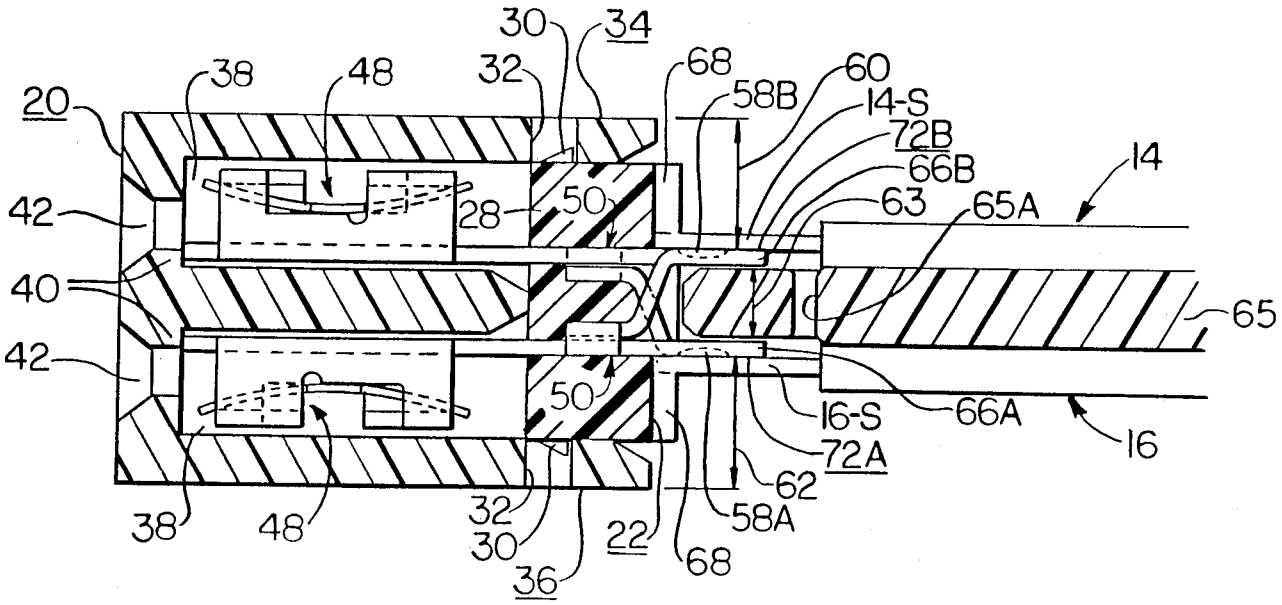
FIG. 9 is a side elevational view entirely in section taken along section lines 9—9 in FIG. 7.

Careful inspection of the terminal members 46 used in the connector 10 of FIGS. 2 and 3 and those in FIGS. 7 and 8 reveals a subtle difference therebetween. In FIGS. 2 and 3, when viewed head-on looking toward the front surface 20 (that is, in the direction of the view arrow V) the left hand tail of any terminal pair (e.g., the tail 50-2, 50-4, 50-6) is associated with the lower one of the vertically stacked pairs of mating ends (i.e., the end 48-2, 48-4 and 48-6, respectively). The right hand tail of a terminal pair (e.g., the tail 50-1, 50-3, 50-5) is associated with the upper of the vertically stacked pairs of mating ends (i.e., the end 48-1, 48-3, 48-5). Such a relationship is termed the "B" orientation.

Figure 13:
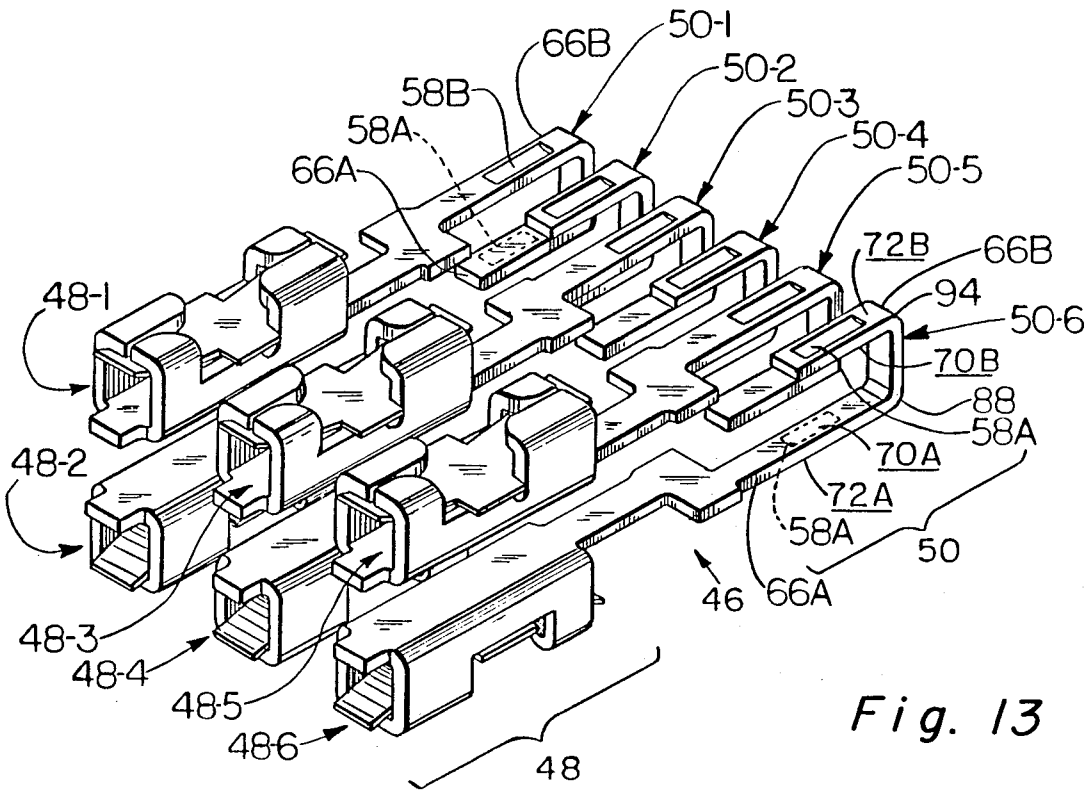
FIG. 13 is an isolated perspective view of a number of terminal members used in the connector shown in FIG. 12.

In FIGS. 7 and 8, from the same vantage point (i.e., in the direction of the view arrow V) the opposite relationship holds true. Here the left hand tail in a pair (e.g., the tail 50-1, 50-3, 50-5) is associated with the upper mating end (i.e., the end 48-1, 48-3, 48-5, respectively). The right hand tail (e.g., the tail 50-2, 50-4, 50-6) is associated with the lower mating end (i.e., the end 48-2, 48-4, 48-6, respectively). This relation is termed the "A" orientation. FIGS. 12 and 13 also illustrate the "A" orientation.

The orientation of a terminal array proves useful in switching the location at which a signal is accessible from the terminal array, i.e., whether a signal is available at the upper or lower array of mating ends. Two connectors each with a like terminal orientation (i.e., both "A" or both "B") will result in no change in signal location. A signal accessible at a lower mating end in a first connector will also be accessible from the second connector at a lower mating end. However, if the orientations of the connectors is mixed (i.e., one "A" and the "B") a signal accessible at an upper mating end in one connector will be available at the lower mating end of the other connector.

Figure 10:
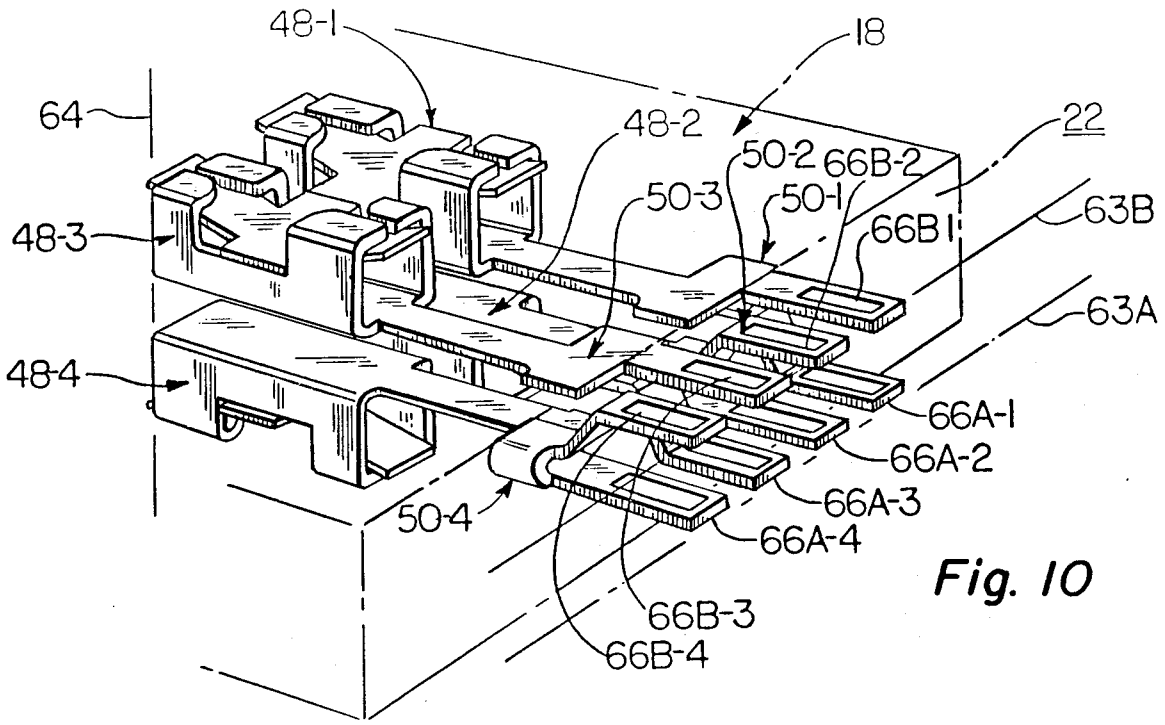
FIG. 10 is an end view generally similar to FIG. 5 taken along section lines 10—10 in FIG. 9 with the connector housing shown in dot-dash lines illustrating the relationship of the mating an tail ends of the terminals used in the connector of FIG. 7.
Figure 11:
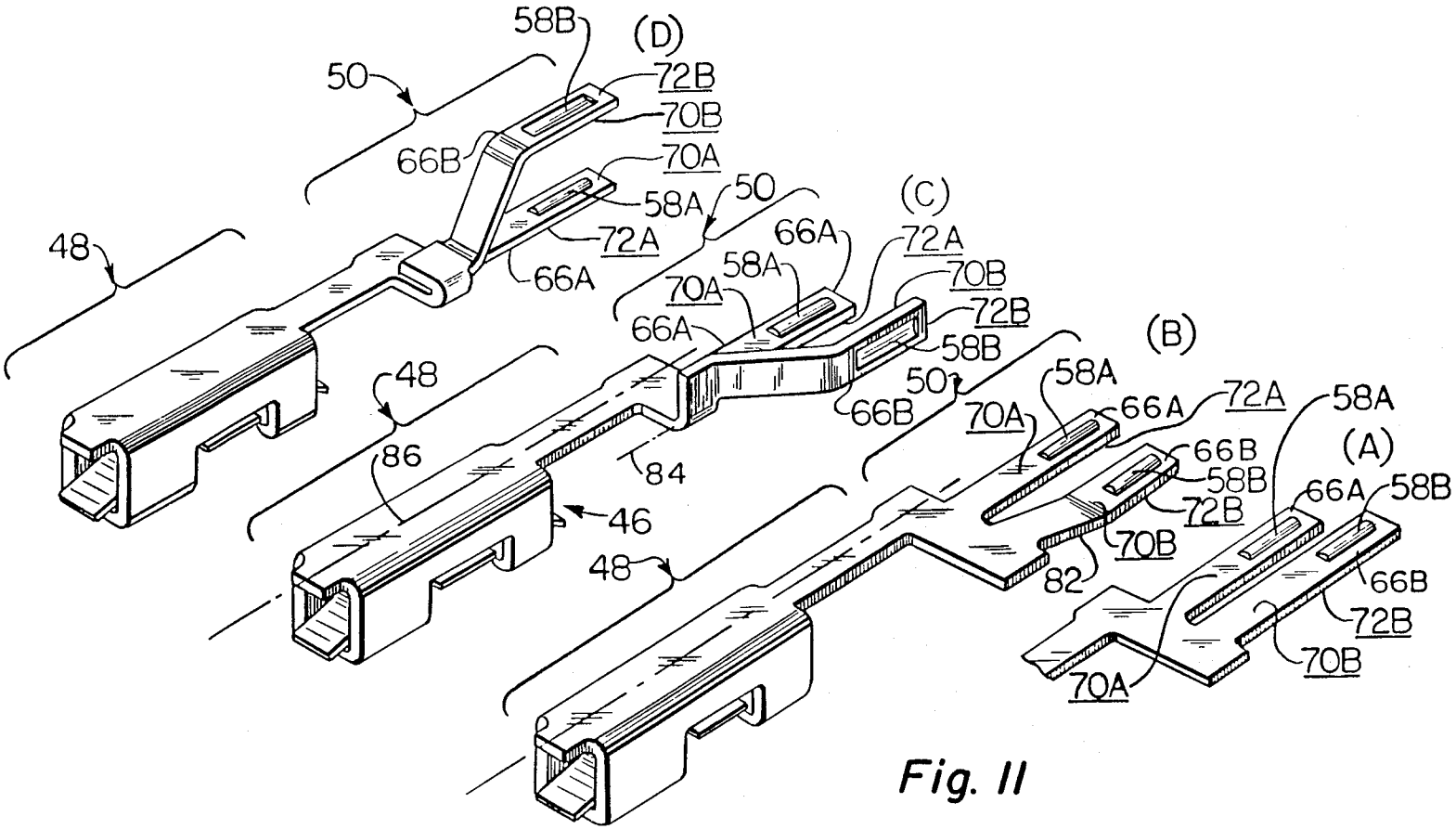
FIGS. 11A through 11D illustrate the sequence of steps used to form a terminal member used in the connector in the embodiment of FIG. 7.

In accordance with the present invention, as seen in FIG. 10, all the legs 66A, 66B associated with the terminals 46 align in respective linear arrays along parallel axes 63A, 63B that extend transversely of the termination surface 22. Similar to the arrangement discussed earlier in connection with FIG. 5 linearly adjacent pairs of tail ends 50 (e.g., the double tailed ends 50-1, 50-2) of the terminal members 46-1, 46-2 correspond to pairs of mating ends 48-1, 48-2, respectively stacked with respect to the vertical axis 64. Due to this arrangement the outside surfaces 72A, 72B on the double tailed ends present mounting surfaces for the conductors (e.g., the signal conductors 14-S, 16-S of the cables 14, 16 respectively) whereby a daisy chain interconnection may be effected. It is noted that the ouside (mounting) surfaces 72A, 72B, respectively provided on the legs 66A, 66B lie in planes that are substantially perpendicular to the termination surface 22 and are preferably spaced equal clearance distances 60, 62 from the corresponding upper and lower surfaces 34, 36 of the housing 18 (FIG. 9), although such spacing is not necessarily mandated.

Figure 6:
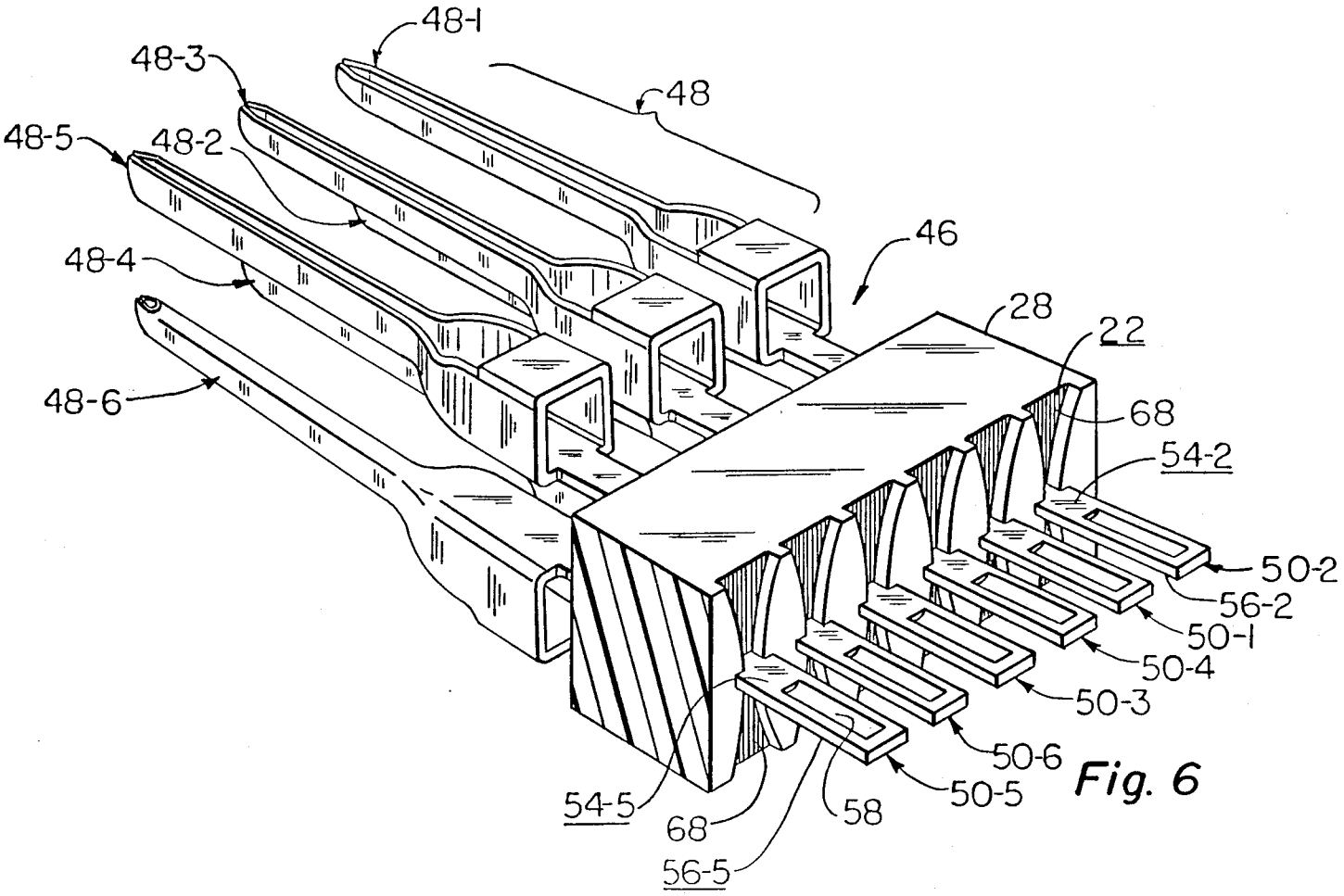
FIG. 6 is a rear perspective view of the connector of FIG. 2 illustrating a wire guide disposed at the rear of the connector housing with the housing removed for clarity of illustration.

To effect the daisy chain interconnection in connection with this embodiment of the invention each of the cables 14, 16 is again supported on the upper and lower surfaces of a substrate 65 the edge of which is inserted into the gap 63 defined between the confronting surfaces 70A, 70B of the legs 66A, 66B on the tail end portion of the terminal member 46. The cables 14, 16 may be affixed to the substrate 65 in any convenient manner, as by an adhesive or clamps. To guide the signal carrying conductors into contact with the solder wells 58A, 58B, respectively provided on the outside surfaces 72A, 72B of the legs 66A, 66B, the guide channels 68 similar to those best shown in FIG. 6 are provided at the termination surface 22 of the housing 18.

Yet another alternate embodiment of the invention is shown in FIGS. 12 through 16. In this embodiment of the invention the tail ends 50 of the terminals 46 take the form of an inverted U. As seen in FIG. 16A the terminal 46 (embedded within a block 28) is provided with an elongated tail end 50 which projects from the terminal bar 28. The tail end 50 is bent at a first location 88 in the direction of the arrow 89 by a suitable crimper (not shown). The bent tail end is then inserted in the direction of the arrow 90 into an aperture 65A provided in the substrate 65. Corresponding operations occur for the terminal shown below the substrate 65. Both tails are then bent in the direction of the arrows 92 (FIG. 16B) at a second spaced location 94 at a second right angle (FIG. 16B) to define the final inverted U-shaped configuration of the tail end 50 of the terminal member 46.

Figure 14:
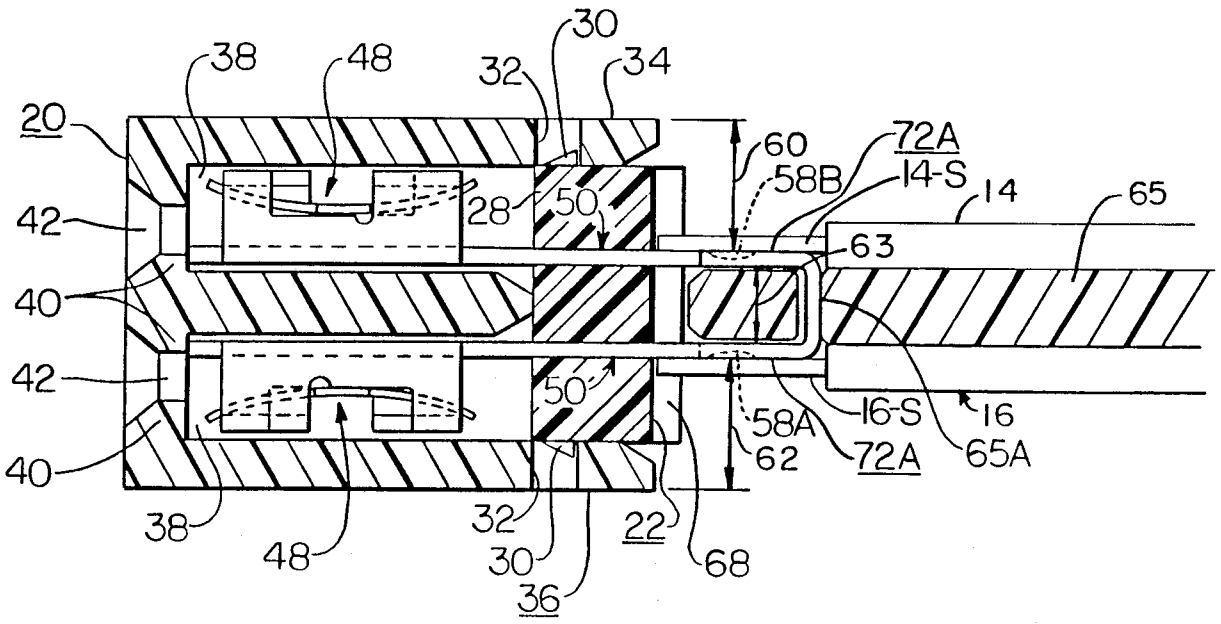
FIG. 14 is a side elevational view entirely in section taken along section lines 14—14 in FIG. 12.

In this embodiment of the invention, as seen in FIG. 13, the tail 50 is provided with confronting surfaces 70A, 70B on the inner surfaces of the legs 66A, 66B of the U and with outside surfaces 72A, 72B on the opposite sides of the legs of the U. The outside surfaces 72A, 72B present mounting surfaces which are able to receive conductors from the cables 14, 16. The surfaces 72A, 72B, similar to the orientation of the corresponding outside mounting surfaces in the other embodiments of the invention, lie in planes substantially perpendicular to the termination surface 22. The mating end 48 of the terminal 46 may again be either or female in configuration, with the female receptacle form being illustrated. Conveniently, but not necessarily, the outside surfaces 72A, 72B of the legs of the U are equally spaced from the upper and lower surfaces 34, 36 of the housing 18 by clearance distances 60, 62, respectively (FIG. 14).

Figure 15:
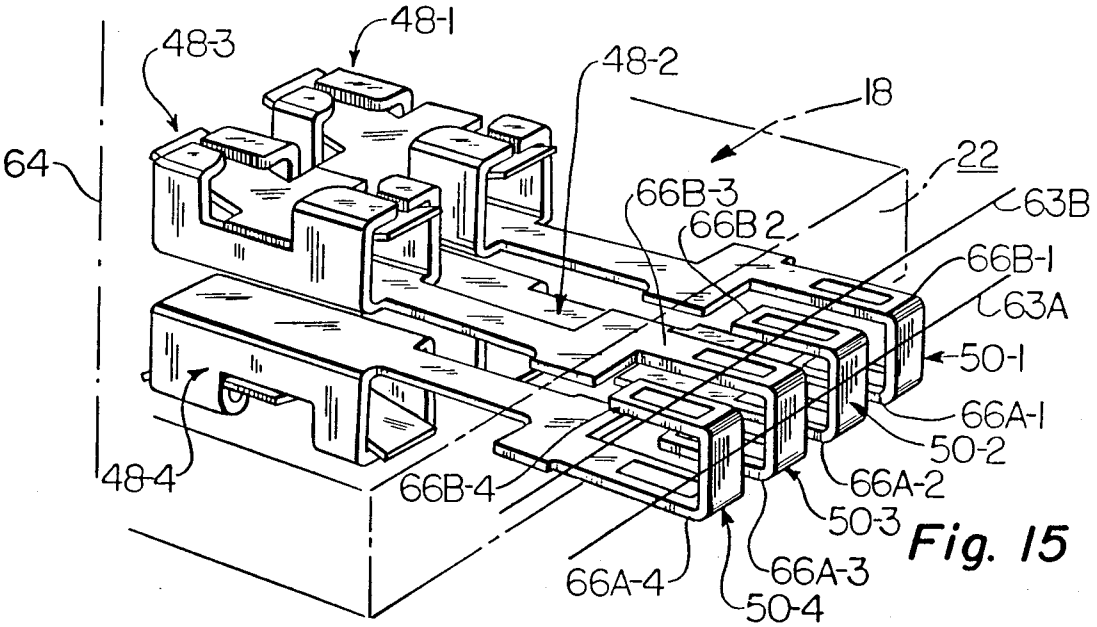
FIG. 15 is an end view taken along section lines 15—15 in FIG. 14 with the connector housing shown in dot-dash lines illustrating the relationship of the mating an tail ends of the terminals used in the connector of FIG. 12.

As seen in FIG. 15 the double-legged tail ends 50 are arranged in a linear array with the legs 66A, 66B of the inverted U respectively aligning along transverse axes 63A, 63B. As in the other embodiments linearly adjacent pairs of the tail ends 50 (e.g., tails 50-1, 50-2) respectively corresponding to stacked pairs of the mating ends 48 (i.e., the ends 48-1, 48-2) that are staked with respect to the vertical axis 64.

As a result of the structure herein described the outside surfaces 72A, 72B present mounting surfaces able to receive conductors from the cables 16, 14, respectively and form a daisy chain interconnection. The daisy chain interconnection with the cables defining the arrays of signal conductors 14 and 16 is effected in a manner similar to that discussed in connection with FIG. 11. The conductors are guided by the channels 68 onto the mounting surfaces defined by the outside surfaces 72A, 72B and soldered or otherwise secured to the legs of the terminal.

Those skilled in the art, having the benefit of the present invention as has been hereinbefore set forth may effect numerous modifications thereto. These modifications should be understood as lying within the scope of the present invention as defined by the appended claims.

What is claimed:

1. A connector for forming a daisy chain interconnection comprising:

a housing;

a plurality of terminal members mounted within the housing, each terminal member having a mating end and a tail end provided thereon, each terminal member being mounted in the housing to define an array of stacked pairs of terminal mating ends;

the tail end of each terminal member projecting from the housing, the tail ends of the terminal members being aligned to form a linear array of tail ends with linearly adjacent pairs of tail ends corresponding to stacked pairs of mating ends;

each tail end having a first and a second mounting surface thereon, each mounting surface being able to receive a conductor thereon.

2. The connector of claim 1 wherein the housing has an upper and a lower surface thereon, and wherein each tail end of each terminal member takes the form of a substantially planar blade having a first and a second outside surface thereon respectively defining the first and the second mounting surface, a first predetermined clearance distance being defined between the first outside surface of each blade and the upper surface of the housing and a second predetermined clearance distance being defined between the second outside surface of each blade and the lower surface of the housing.

3. The connector of claim 2 wherein the first and the second clearance distances are equal.

4. The connector of claim 2 further comprising a wire guide disposed on the housing, the wire guide having guide channels formed therein for guiding a wire into engagement with each mounting surface of each tail end.

5. The connector of claim 2 further comprising a solder well being disposed on each mounting surface of the planar blade.

6. The connector of claim 3 further comprising a solder well being disposed on each mounting surface of the planar blade.

7. The connector of claim 1 wherein the housing has an upper and a lower surface thereon, and wherein each tail end of each terminal member has a substantially Y shape with each leg of the Y having a confronting surface and an outside surface thereon, each outside surface defining one of the mounting surfaces, a first predetermined clearance distance being defined between the outside surface of one leg of the Y and the upper surface of the housing and a second predetermined clearance distance being defined between the outside surface of the other leg of the Y and the lower surface of the housing.

8. The connector of claim 7 wherein the first and the second clearance distances are equal.

9. The connector of claim 7 wherein the terminal is formed from integral stock.

10. The connector of claim 7 further comprising a solder well being disposed on the mounting surface of each leg of the Y.

11. The connector of claim 7 further comprising a wire guide disposed on the housing, the wire guide having guide channels formed therein for guiding a wire into engagement with each mounting surface of each tail end.

12. The connector of claim 1 wherein the housing has an upper and a lower surface thereon, and wherein each tail end of each terminal member has a substantially inverted U shape with each leg of the U having a confronting surface and an outside surface thereon, each outside surface defining one of the mounting surfaces, a first predetermined clearance distance being defined between the outside surface of one leg of the U and the upper surface of the housing and a second predetermined clearance distance being defined between the outside surface of the other leg of the U and the lower surface of the housing.

13. The connector of claim 12 wherein the first and the second clearance distances are equal.

14. The connector of claim 12 wherein the terminal is formed from integral stock.

15. The connector of claim 12 further comprising a solder well being disposed on the mounting surface of each leg of the U.

16. The connector of claim 12 further comprising a wire guide disposed on the housing, the wire guide having guide channels formed therein for guiding a wire into engagement with each mounting surface of each tail end.

17. The connector of claim 1 further comprising a wire guide disposed on the housing, the wire guide having guide channels formed therein for guiding a wire into engagement with the mounting surface on each tail end.

* * * * *